US008369553B2

(12) United States Patent
Dumas et al.

(10) Patent No.: US 8,369,553 B2
(45) Date of Patent: Feb. 5, 2013

(54) HEARING ASSISTANCE DEVICE WITH STACKED DIE

(75) Inventors: Craig Dumas, Mayer, MN (US); Douglas F. Link, Plymouth, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 841 days.

(21) Appl. No.: 12/340,627

(22) Filed: Dec. 19, 2008

(65) Prior Publication Data

US 2010/0158296 A1 Jun. 24, 2010

(51) Int. Cl.
*H04R 25/00* (2006.01)

(52) U.S. Cl. ..... 381/324; 381/314; 381/323; 257/778

(58) Field of Classification Search ..... 381/314, 381/323, 324, 328; 257/724, 777, 778
See application file for complete search history.

(56) References Cited

U.S. PATENT DOCUMENTS 5,987,357 A 11/1999 Prutchi et al.
6,771,786 B1 * 8/2004 Skindhøj et al. ..... 381/324
7,111,149 B2 9/2006 Eilert
7,279,795 B2 * 10/2007 Periaman et al. ..... 257/777
2004/0141627 A1 * 7/2004 Paczkowski ..... 381/324
2007/0228546 A1 10/2007 So et al.
2008/0192967 A1 * 8/2008 Chan et al. ..... 381/312

FOREIGN PATENT DOCUMENTS

WO WO-0110167 A2 2/2001
WO WO-2007148154 A1 12/2007

* cited by examiner

*Primary Examiner* — Matthew E Warren
(74) *Attorney, Agent, or Firm* — Schwegman, Lundberg & Woessner, P.A.

(57) ABSTRACT

The present subject matter relates to a hearing assistance device for an ear of a wearer comprising a microphone for receiving sound, hearing assistance electronics in communications with the microphone, the hearing assistance electronics including a hybrid circuit, and a wearable housing adapted to house at least the hearing assistance electronics. The hybrid circuit comprises a first integrated circuit die having one or more through-silicon-vias (TSVs), a first redistribution layer disposed on a surface of the first integrated circuit, and a second integrated circuit die having one or more contacts, the second integrated circuit die disposed on the first redistribution layer, wherein the first redistribution layer is adapted to connect one or more of the one or more TSVs of the first integrated circuit die to one or more of the one or more contacts of the second integrated circuit die.

20 Claims, 6 Drawing Sheets

HEARING ASSISTANCE DEVICE WITH STACKED DIE

TECHNICAL FIELD

The present subject matter relates generally to hearing assistance devices and in particular to hearing assistance devices with stacked die electronics.

BACKGROUND

Current hearing assistance devices employ sophisticated electronics to processes audio signals in a manner and time-frame to compliment the hearing capabilities of the user. One type of hearing assistance device, the hearing aid, provides advanced sound processing in a small package size. Hearing aid wearers appreciate devices that provide hearing assistance without drawing attention to the device. However, connecting components in such devices can be very time consuming and prone to error. The result can be reduced yields for each manufacturer.

There is a need in the art for small packaging of sophisticated electronics for use in hearing assistance electronics, such as hearing aids. Robust designs that are straightforward to assemble and which provide high yields offer advantages over existing solutions.

SUMMARY

This application addresses the foregoing needs in the art and other needs not discussed herein. One embodiment of the present subject matter relates to a hearing assistance device for an ear of a wearer including a microphone for receiving sound, hearing assistance electronics in communications with the microphone, the hearing assistance electronics including a hybrid circuit comprising a first integrated circuit die including a plurality of integrated circuits connected to a plurality of active pads, the first integrated circuit die including one or more through-silicon-vias (TSVs) located within an area defined by the plurality of active pads, a second integrated circuit die having a plurality of contacts, and a first redistribution layer adapted to connect at least one TSV of the one or more TSVs of the first integrated circuit die to at least one contact of the plurality of contacts of the second integrated circuit die, and a wearable housing configured to house at least the hearing assistance electronics.

In various embodiments, the hybrid circuit includes a digital signal processor (DSP) and a second chip connected to the DSP, such as a wireless communications electronics chip or a memory chip. Variations may include a plurality of chips placed over each other and using the TSVs connected to the redistribution layers. Variations may also include various passive components mounted on a first chip and connected to the redistribution layer.

Various hearing assistance device embodiments, include, but are not limited to hearing aids, such as in-the-canal, receiver-in-the-ear, behind-the-ear, and completely-in-the-canal designs.

Methods for making the designs are also provided.

This Summary is an overview of some of the teachings of the present application and is not intended to be an exclusive or exhaustive treatment of the present subject matter. Further details about the present subject matter are found in the detailed description and the appended claims. The scope of the present invention is defined by the appended claims and their legal equivalents.

DETAILED DESCRIPTION

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

Figure 1A:
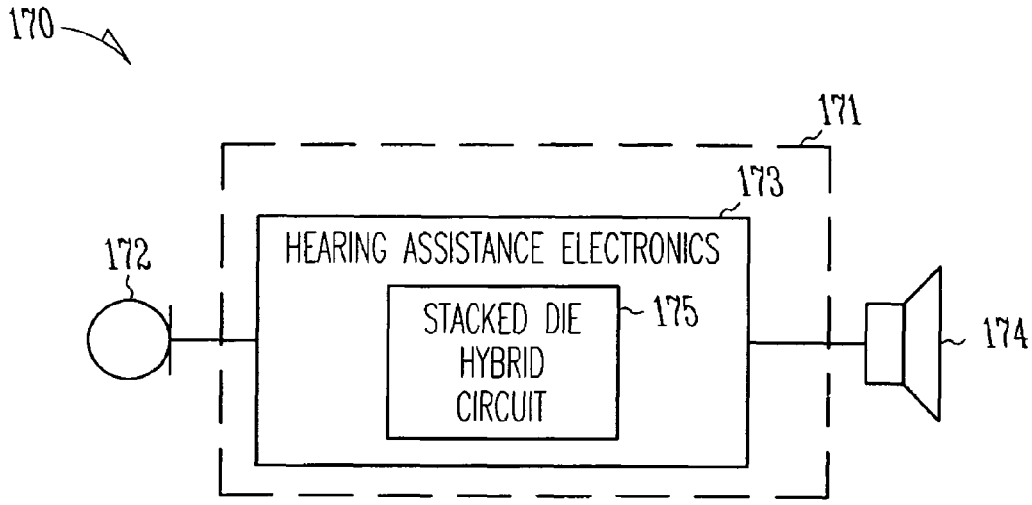
FIG. 1A shows a block diagram of a hearing assistance device according to one embodiment of the present subject matter.

FIG. 1A shows a block diagram of a hearing assistance device 170 according to one embodiment of the present subject matter. In various embodiments, the hearing assistance device 170 is a hearing aid. The hearing assistance device 170 includes hearing assistance electronics 173 enclosed in a housing 171. A microphone 172 is connected to the hearing assistance electronics 173 and is adapted convert sound into an electrical signal representative of the sound. The resulting signal can be processed using the hearing assistance electronics 173. For applications relating to hearing aids, the hearing assistance electronics 173 includes programmable gain which is adapted to correct for the hearing loss of a wearer, typically characterized by the wearer's audiogram. A speaker (in hearing aid technology, this is called a "receiver") 174 connected to the hearing assistance electronics 173 is adapted to produce a processed signal based on the signal of the microphone 172 and play it to the wearer's ear. In various embodiments, hearing assistance electronics are enclosed in a housing worn behind or about the wearer's ear and the receiver is positioned in the ear or the ear canal of the wearer. In various embodiments, the hearing assistance electronics 173 includes a stacked die hybrid circuit 175 for processing the microphone signal and controlling the operation of the hearing assistance device. In various embodiments, the stacked die hybrid circuit 175 includes an integrated circuit die adapted for digital signal processing and an integrated circuit die adapted for data storage. Other die combinations are possible without departing from the scope of the present subject matter. The die combinations described herein are intended to demonstrate the present subject matter and are not intended in a limited or exclusive sense.

Figure 1B:
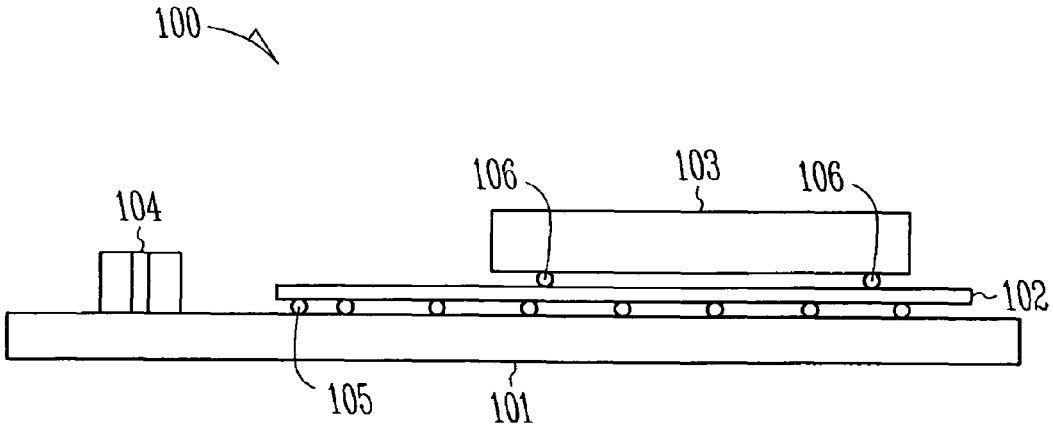
FIG. 1B shows a stacked die hybrid circuit for a hearing assistance device according to one embodiment of the present subject matter.

FIG. 1B shows a stacked die hybrid circuit 100 for a hearing assistance device according to one embodiment of the present subject matter. This stacked die hybrid circuit can be used in the device 170 of FIG. 1 for stacked die hybrid circuit 175. Other variations are possible without departing from the scope of the present subject matter. The stacked die hybrid circuit 100 includes a substrate 101, a first integrated circuit 102, and a second integrated circuit 103. In various embodiments, the stacked die hybrid circuit 100 includes another component 104. In various embodiments, the component 104 is an active component. In various embodiments, the component 104 is a passive component. It is understood that component 104 is optional and may include one or more of a passive component and/or an active component, and may include combinations thereof. The first integrated circuit 102 is a thin flip chip.

In general, a flip chip is an integrated circuit without bond wires to the connectors of the chip. Integrated circuits are manufactured using silicon wafers. Various processes manipulate the wafer resulting in an integrated circuit chip with active components embedded and/or built upon one side of the wafer. In some integrated circuit chips, chip connections use a bond wire extending between a perimeter connector and an active pad near or within the area of the integrated circuit components of the die. Flip-chips reduce the need for bond wires. In place of bond wires, a flip chip provides bond pads for directly connecting the chip to a substrate or circuit board. The term "flip chip" denotes the flipped orientation of the active side of the silicon chip when connected to a substrate as opposed to the orientation of the active side when using wire bond connections. In flip chip designs, active pads provide connections to the active components. These active pads are at or near the region where the active components reside (sometimes called the "active region.").

In various embodiments, the first integrated circuit chip 102 connects to the substrate 101 using conductive bumps 105 connected to the chip bond pads. The conductive bumps are soldered to the substrate 101 to provide both a mechanical and an electrical coupling. In various embodiments, the second integrated circuit 103 also uses flip chip technology to connect to the assembly. In various embodiments, the second integrated circuit connects to traces on the first integrated circuit 102. The first integrated circuit chip 102 includes vias to electrically connect the second integrated circuit chip 103 to the first integrated circuit 102.

Through-silicon-vias are small vertical electrical connections extending through the silicon of an integrated circuit (IC). In various embodiments, one end of a via terminates at a metallization layer existing at the active side of the IC chip and connected among the active components embedded in and/or built upon the IC's silicon. The metallization layer is enclosed between two passivation layers.

In various embodiments, the second integrated circuit chip 103 connects to a redistribution layer positioned between the second integrated circuit 103 and the first integrated circuit 102. The redistribution layer includes conductive traces for connecting the conductive bumps 106 of the second integrated circuit 103 with the vias extending through the first integrated circuit 102. In various embodiments, other components 104 connect to the assembly and are mounted to the substrate 101. Capacitors, resistors, transistors, and fuses are examples of other components 104. In various embodiments, the first 102 and second 103 integrated circuits are heterogeneous ICs for use in a hearing assistance device. For example, in one embodiment, the first integrated circuit chip 102 is a digital signal processor (DSP) and the second integrated circuit 103 is a memory chip such as an electrically erasable programmable read only memory (EEPROM). Other combinations are possible without departing from the scope of the present subject matter.

Figure 2A:
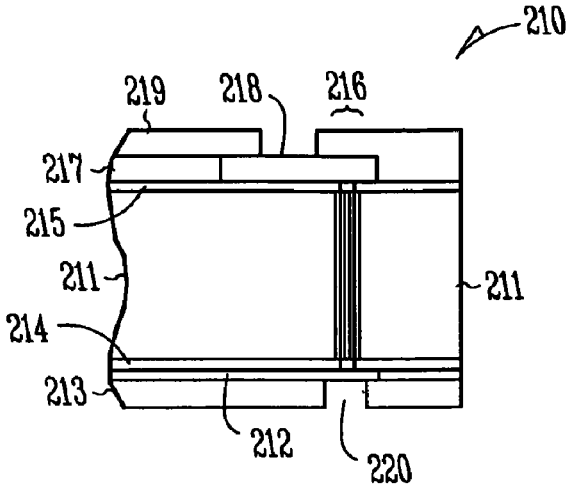
FIGS. 2A and 2B show cross sections of a first integrated circuit chip according to one embodiment of the present subject matter.

FIG. 2A shows a cross section of a first integrated circuit chip 210 according to one embodiment of the present subject matter. Chip 210 can be used in the design of FIG. 1B as first integrated circuit chip 102. Chip 210 includes a layer of silicon 211, with a metallization layer 212 between two passivation layers 213, 214 on the "active" side of the silicon layer 211. Active pads 220 are located at openings in the passivation layers 213 and 214 where the metallization layer 212 is accessible. Chip 210 also includes a passivation layer 215 on the other side of the silicon layer 211 and a contact layer 218 electrically connected to the via 216 to connect another device to the metallization layer 212 of the illustrated chip 210. The via 216 allows a second integrated circuit chip to be stacked with the first integrated circuit chip and provides a stacked connection using contact layer 218 to reduce the overall physical size of the circuit and to make a straightforward connection.

Figure 2B:
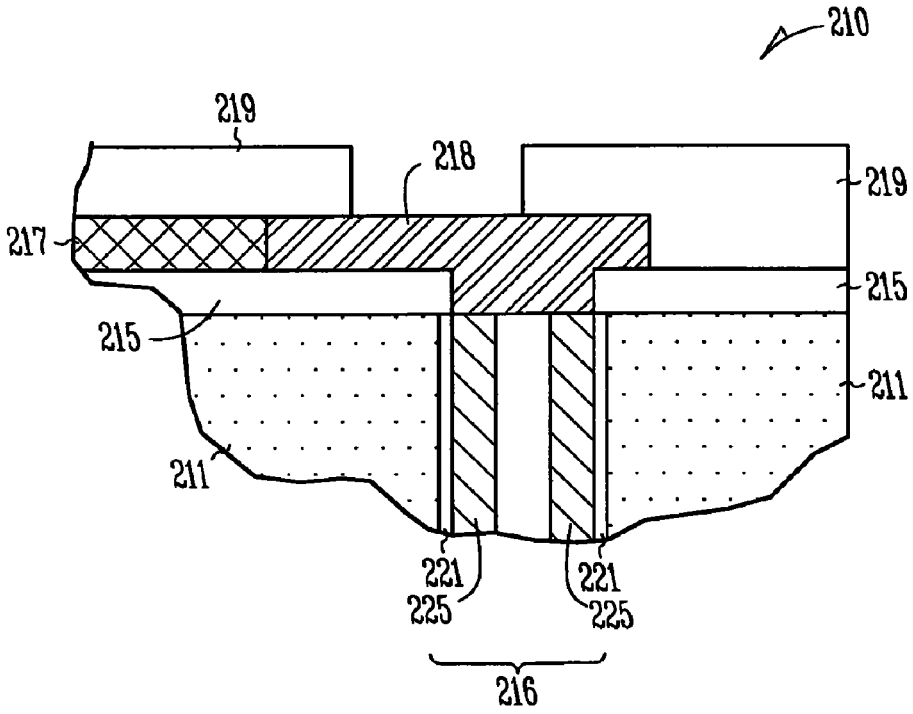

A through-silicon-via 216 can be formed in the silicon wafer at various process steps during IC fabrication such as FEOL (front end of the line), BEOL (back end of the line), and post IC fabrication. In BEOL and post IC fabrication, the through-silicon-via is formed in an existing integrated circuit chip by boring a hole through the silicon of the chip to an unaltered metallization layer on the active side of the chip. Deep reactive ion etching (DRIE) is one example of technology used to bore the initial hole through the silicon. The interior of the via 216 is then coated with a passivation layer (represented by insulation layer 221 in FIG. 2B) to insulate the subsequent conductive via layer 225 from the silicon 211. In some embodiments, the passivation layer is a dielectric sleeve formed by deposition of tetraethyl orthosilicate (TEOS) or similar semiconductor passivation method. An electroless seed layer of conductive material is then applied and the hole is then either completely filled or lined to form a barrel with an electroplated conductor 225 such as copper or tungsten to form a conductive path from the metallization layer 212 on the active side of the silicon chip to redistribution layer 217 of the inactive side of the silicon chip.

Various processes can be used to produce through-silicon-vias within the active region of the die. Such processes, include, but are not limited to DRIE, wet-etch, and laser milling. Such processes do not require additional real estate outside of the existing active region of the die to form the through-silicon-vias (TSVs).

The illustrated integrated circuit chip embodiment of FIG. 2A includes redistribution layer 217. The redistribution layer 217 includes contact layer 218 accessible through an opening in an outer passivation layer 219. The distribution layer 217 connects the via 216 with the appropriate termination of the second integrated circuit chip. In various embodiments, TSVs are formed within the region defined by the active pads of a first custom chip (sometimes called the "active region"). Such designs do not require extra real estate for the TSVs. A redistribution layer is configured to connect one or more chips to the first chip in a stacked configuration. In some embodiments, the redistribution layer is configured to connect the first chip to a second chip which is an off-the-shelf component. One advantage of the TSVs is that they conserve real estate of the chip by providing a vertical electrical connection between the redistribution layer and active pads in the active region of the chip.

In various embodiments, a bonding pad is fabricated at contact layer 218 on the inactive side of a first integrated circuit die. A separate redistribution layer connects the via to one or more bonding pads of a second integrated circuit die disposed on the first die. In some embodiments, a wire bond pad is formed on contact layer 218 for wire bonding a die, active side-up, to the first integrated circuit chip. Although the illustrated embodiments show hybrid circuits including two stacked dies, it is understood that stacking addition dies is possible without departing from the scope of the present subject matter.

Figure 3:
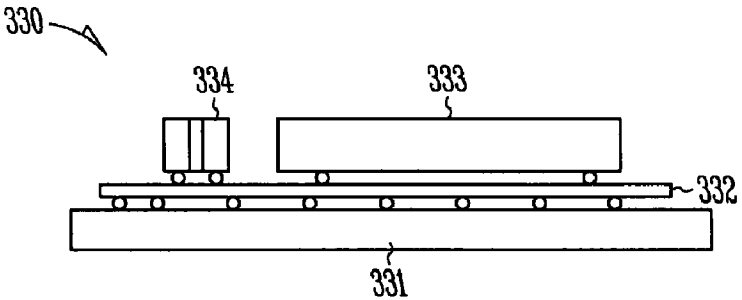
FIG. 3 shows a stacked die hybrid circuit according to one embodiment of the present subject matter.

FIG. 3 shows a stacked die hybrid circuit 330 according to one embodiment of the present subject matter. The circuit 330 includes a substrate 331, a first thinned integrated circuit chip 332 mounted to the substrate 331, a second integrated circuit chip 333 mounted to the first integrated circuit chip 332 and in electrical communication with the first integrated circuit chip 332 using vias in the first chip, and a capacitor 334 mounted to the first integrated circuit chip 332. Mounting the capacitor 334, or other components such as resistors, on the first integrated circuit chip 332 reduces the size of the substrate 331 and the overall size of the hearing assistance electronics. This size reduction increases versatility in the design of the hearing assistance device. In various embodiments, conductive traces are plated to a passivation layer on the inactive side of the first integrated circuit chip 332 for connecting the terminations of the second integrated circuit chip 333 and the capacitor 334 with each other or with one or more vias extending into the first integrated circuit chip.

Figure 4:
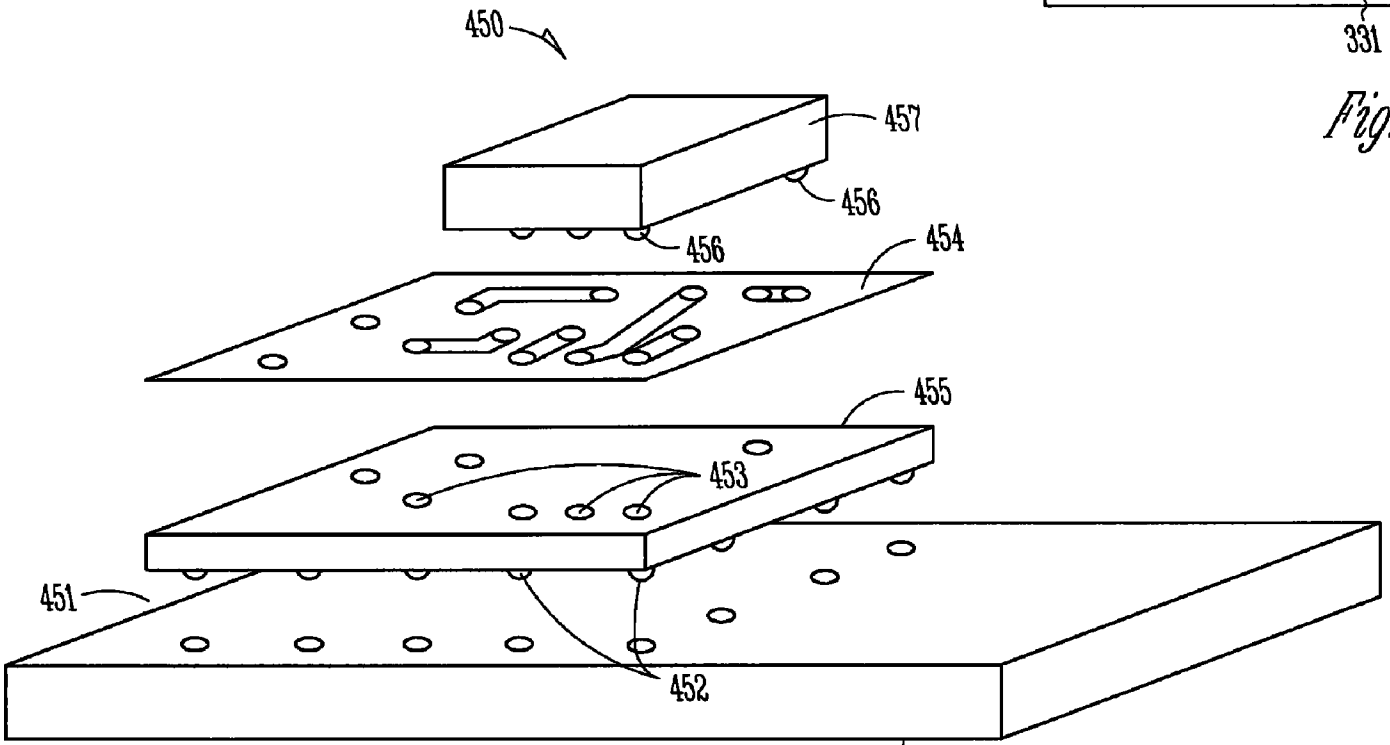
FIG. 4 shows a perspective and exploded view of a DSP and EEPROM stack for a hearing assistance device according to one embodiment of the present subject matter.

FIG. 4 shows a perspective and exploded view of a digital signal processor (DSP) 455 and electrically erasable programmable read only memory (EEPROM) 457 configured in a stack 450 for a hearing assistance device according to one embodiment of the present subject matter. The DSP 455 includes a side 451 with flip chip interconnects 452 such as conductive bumps and/or solder balls. The side of the DSP 455 includes terminations of vias 453 extending into the DSP chip 455. The illustrated embodiment includes a redistribution layer 454 with conductive material integrated with an insulating material to provide connections between the vias 453 and the flip chip terminations 456 of the EEPROM 457. In various embodiments, the redistribution layer 454 includes terminations and connecting traces for additional stacked integrated circuit components. In various embodiments one or more active components, passive components (including, but not limited to capacitors, resistors and fuses), and combinations thereof can be connected, for example. In some embodiments, interconnect traces and bonding pads for connecting the EEPROM 457 to the vias 453 of the DSP 455 are integrated with the DSP 455 using coatings and/or plating to attach and insulate the traces and bonding pads onto the DSP. It is understood that combinations of other integrated circuit component stacks to form a hybrid hearing assistance circuit are possible without departing from the scope of the present subject matter.

In one embodiment, the redistribution layer is a coating. In one embodiment the redistribution layer is a plating. In various embodiments, coating, plating or combinations thereof are used to attach and insulate the traces and bonding pads onto the surface of the first chip. In various embodiments, the redistribution layer is configured to connect a chip to an off-the-shelf chip, such as a memory chip. Other types of chips can be connected, whether standard off-the-shelf or custom integrated circuits.

In some embodiments, the stacked die hybrid circuit assembly includes two or more addressable integrated circuit chips in a stacked configuration with a redistribution layer between each chip. In various embodiments, traces are severed on one or more of the redistribution layers to configure the addressing of the stacked chips, or dies. One way to sever a trace is to use laser obliteration. Another method is to provide fusible links in the redistribution layer which are used to sever connections as desired.

In some embodiments, traces are printed to provide the proper connection between a TSV of one chip and a connection pad or ball of a stacked die or other device. Direct-print technology allows a thin line of conductive material to be dispensed through a nozzle on to a substrate or a surface of a die to form the traces of the redistribution layer between stacked dies. In some embodiments, direct-print technology is used to print three-dimensional traces such that a direct-print trace connects a signal available near one side of a die to a redistribution layer on the opposite or an adjacent side of the die.

Other ways of chip selection are possible without departing from the scope of the present subject matter.

Figure 5:
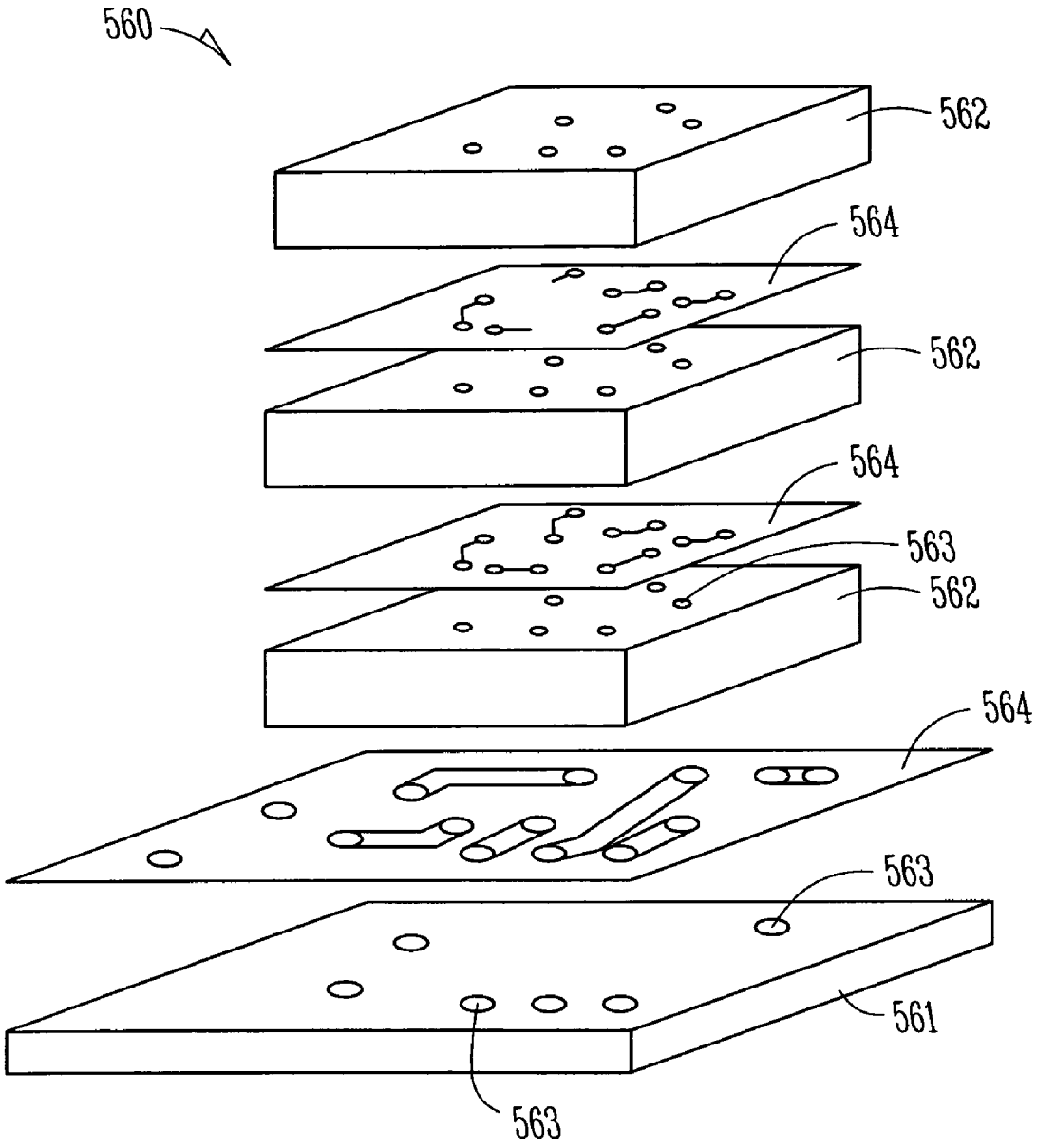
FIG. 5 shows a stacked die hybrid circuit for a hearing assistance device according to one embodiment of the present subject matter.

In various embodiments, the stacked die hybrid circuit assembly for a hearing assistance device includes additional chips stacked upon the first chip, the second chip or the first and second chip. FIG. 5 shows a stacked die hybrid circuit for a hearing assistance device according to one embodiment of the present subject matter. The circuit 560 includes a DSP 561 with three memory chips 562 in a stacked configuration. TSVs 563 and a redistribution layer 564 between adjacent chips distribute power and control signals to the stacked chips.

Figure 6:
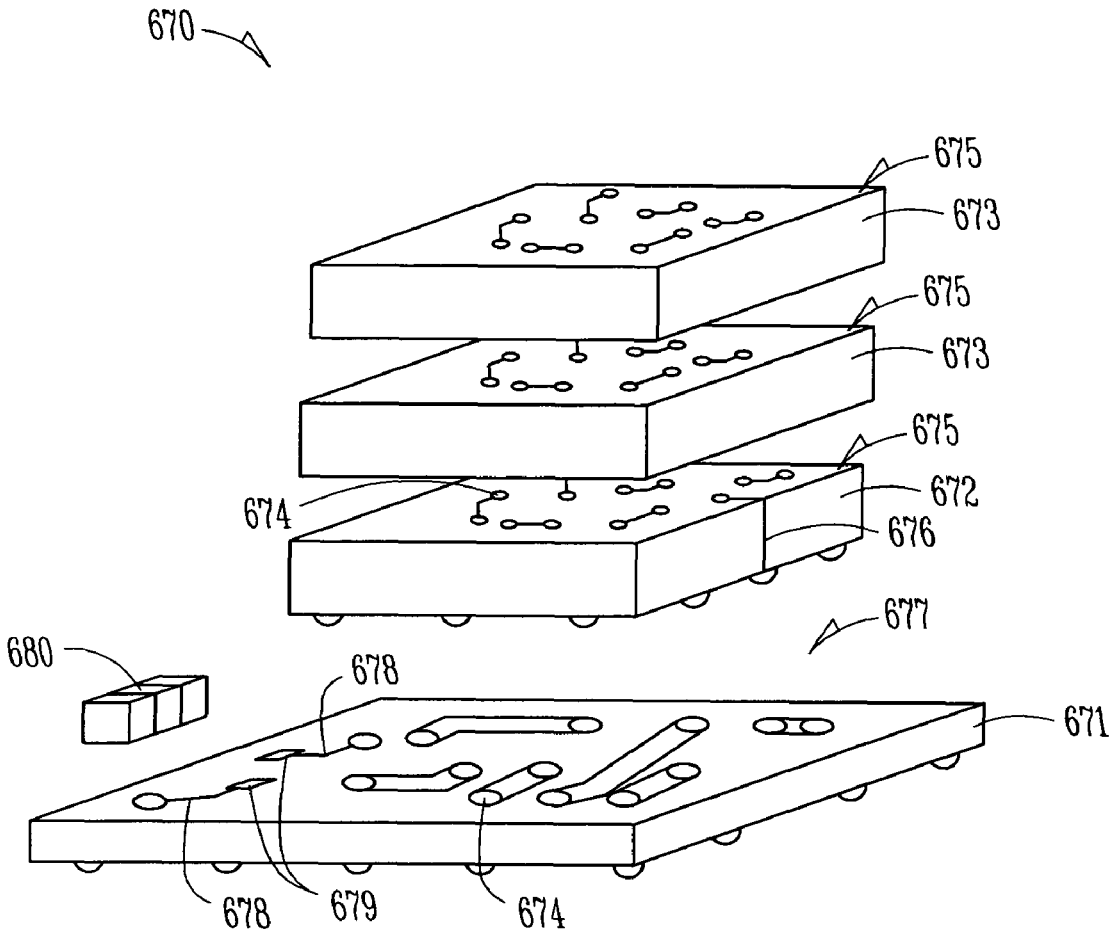
FIG. 6 shows a stacked die hybrid circuit for a hearing assistance device according to one embodiment of the present subject matter.

FIG. 6 shows a stacked die hybrid circuit for a hearing assistance device according to one embodiment of the present subject matter. The circuit 670 includes a DSP 671, a wireless communications chip 672 and a plurality of memory chips 673 in a stacked configuration. TSVs 674 and redistribution layers 675 between adjacent chips distribute power and control signals to the stacked chips. A direct print trace 676 connects a signal available on one side of the wireless communications chip 672 to the redistribution layer on the opposite side of the wireless communications chip. The redistribution layer 677 of the DSP includes traces 678 and contact pads 679 for a capacitor 680 mounted in a stacked configuration on the DSP. It is understood that combinations of other integrated circuit component stacks to form a stacked die hybrid circuit assembly for a hearing assistance device are possible without departing from the scope of the present subject matter.

Figure 7:
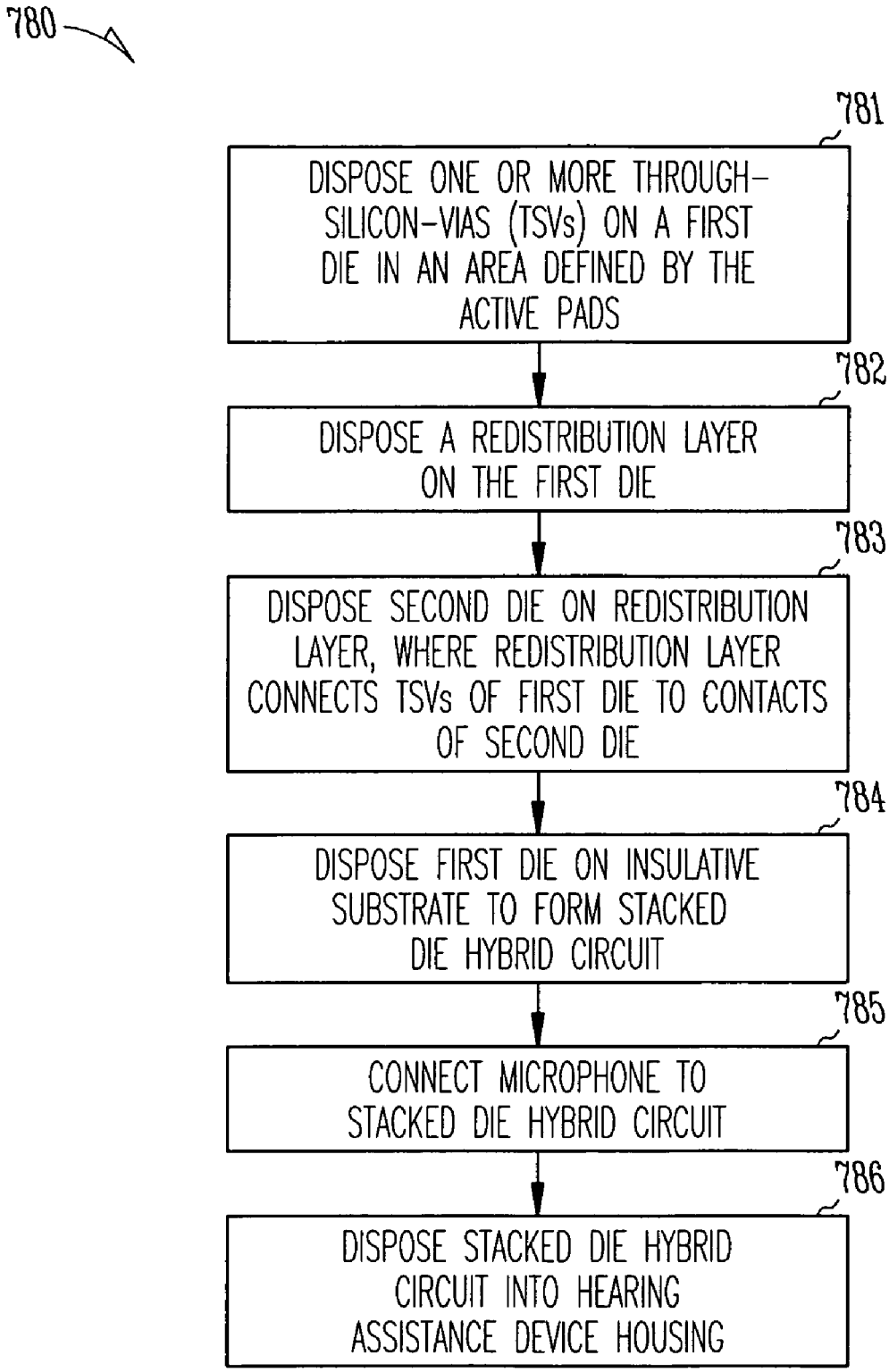
FIG. 7 is a flow diagram of a method for assembling a hearing assistance device with a stacked die hybrid circuit according to one embodiment of the present subject matter.

FIG. 7 is a flow diagram of a method for assembling a hearing assistance device with a stacked die hybrid circuit according to one embodiment of the present subject matter. The method 780 includes disposing one or more TSVs to an area defined by active pads of a first integrated circuit die 781, disposing a redistribution layer on a first integrated circuit die 782, disposing a second integrated circuit die on the redistribution layer 783, and disposing the first integrated circuit die on an insulative substrate to form a stacked die hybrid circuit for a hearing assistance device 784. The redistribution layer connects the through-silicon-vias of the first integrated circuit die to contacts of the second integrated circuit die, thus, distributing one or more signals through the stacked configuration. The method further includes connecting a microphone to the stacked die hybrid circuit 785 and disposing the circuit in a hearing assistance device housing 786. In various embodiments, the second integrated circuit die includes through-silicon-vias to allow additional integrated circuit dies or circuit components to be disposed thereon. In various embodiments, the first integrated circuit die is of a different type than the second integrated circuit die, for example, in one embodiment, the first integrated circuit die is a processor and the second integrated circuit die is a memory circuit. In one embodiment, the first integrated circuit die is a digital signal processor and the second integrated circuit die is a wireless communications circuit. It is understood that adding additional redistribution layers and adding integrated circuit dies are possible without departing from the scope of the present subject matter.

The present subject matter includes hearing assistance devices, including, but not limited to, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in-the-canal. It is understood that other hearing assistance devices not expressly stated herein may fall within the scope of the present subject matter.

This application is intended to cover adaptations and variations of the present subject matter. It is to be understood that the above description is intended to be illustrative, and not restrictive. The scope of the present subject matter should be determined with reference to the appended claim, along with the fall scope of equivalents to which the claims are entitled.

What is claimed is:

1. A hearing assistance device for an ear of a wearer, comprising:

a microphone for receiving sound;

hearing assistance electronics in communications with the microphone, the hearing assistance electronics including a hybrid circuit comprising:

an addressable first integrated circuit die including a plurality of integrated circuits connected to a plurality of active pads, the first integrated circuit die including one or more through-silicon-vias (TSVs) located within an area defined by the plurality of active pads;

an addressable second integrated circuit die having a plurality of contacts; and a first redistribution layer positioned between the first and second integrated circuit dies and adapted to connect at least one TSV of the one or more TSVs of the first integrated circuit die to at least one contact of the plurality of contacts of the second integrated circuit die;

wherein the first redistribution layer includes traces that are severed to configure addressing of the first and second integrated circuit dies; and a wearable housing configured to house at least the hearing assistance electronics.

2. The device of claim 1, further comprising a passive component disposed on the first redistribution layer.

3. The device of claim 1, wherein the first redistribution layer comprises a metal layer and a passivation layer integrated with the first integrated circuit die.

4. The device of claim 1, wherein the first redistribution layer comprises one or more conductive traces disposed on the surface of the first integrated circuit die.

5. The device of claim 4, further comprising a passive component disposed on the first integrated circuit die.

6. The device of claim 1, wherein the first integrated circuit is a digital signal processor (DSP).

7. The device of claim 6, wherein the second integrated circuit is an electrically erasable programmable read only memory (EEPROM) device.

8. The device of claim 1, wherein the second integrated circuit die includes wireless communications electronics.

9. The device of claim 8, wherein the first integrated circuit die is a DSP.

10. The device of claim 8, further comprising one or more memory chips connected to the second integrated circuit die, wherein a first memory chip of the one or more memory chips is disposed on a second redistribution layer and the second redistribution layer is disposed on the second integrated circuit die.

11. The device of claim 1 wherein the housing is a behind-the-ear (BTE) housing.

12. The device of claim 1, wherein the housing is a receiver in the canal (RIC) housing.

13. The device of claim 1, wherein the housing is an in-the-canal (ITC) housing.

14. The device of claim 1, wherein the housing is a completely-in-the-canal (CIC) housing.

15. The device of claim 1, further comprising a receiver adapted to receive a signal from the hearing assistance electronics.

16. The device of claim 15, wherein the receiver is adapted to be worn in the ear of the wearer.

17. The device of claim 15, wherein the receiver is housed in the housing.

18. A method for making a hearing assistance device for an ear of a wearer, the method comprising:

disposing one or more through-silicon-vias (TSVs) in an area defined by active pads of an addressable first integrated circuit die, disposing a redistribution layer onto the first integrated circuit die, disposing an addressable second integrated circuit die having one or more contact pads on to the redistribution layer, wherein the redistribution layer connects one or more of the one or more TSVs to one or more of the one or more contact pads;

severing traces of the redistribution layer to configure addressing of the first and second integrated circuit dies; and disposing the first integrated circuit die on an insulative substrate, wherein the insulative substrate, first integrated circuit die, redistribution layer and second integrated circuit die form a stacked die hybrid circuit with a geometry suitable for placement within a housing of the hearing assistance device.

19. The method of claim 18, further comprising connecting a microphone to the hybrid circuit.

20. The method of claim 19, further comprising disposing the microphone, and hybrid circuit within a housing adapted to be worn about the ear.

* * * * *